US010392872B2

(12) United States Patent
Chambers et al.

(10) Patent No.: US 10,392,872 B2
(45) Date of Patent: Aug. 27, 2019

(54) PRESSURE CONTROL DEVICE FOR USE WITH A SUBTERRANEAN WELL

(71) Applicant: WEATHERFORD TECHNOLOGY HOLDINGS, LLC., Houston, TX (US)

(72) Inventors: James W. Chambers, Houston, TX (US); Lev Ring, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 16 days.

(21) Appl. No.: 15/597,813

(22) Filed: May 17, 2017

(65) Prior Publication Data

US 2018/0334862 A1 Nov. 22, 2018

(51) Int. Cl.

| | |
|---|---|
| ***E21B 17/05*** | (2006.01) |
| ***E21B 33/12*** | (2006.01) |
| ***E21B 33/08*** | (2006.01) |

(52) U.S. Cl.

CPC ..... *E21B 17/05* (2013.01); *E21B 33/085* (2013.01); *E21B 33/12* (2013.01)

(58) Field of Classification Search

CPC ..... E21B 17/05; E21B 33/12; E21B 33/085
See application file for complete search history.

(56) References Cited

U.S. PATENT DOCUMENTS

| | | | | |
|---|---|---|---|---|
| 2,333,847 | A * | 11/1943 | Deely | E21B 3/04 166/86.2 |
| 3,409,084 | A | 11/1968 | Lawson et al. | |
| 3,498,643 | A | 3/1970 | Reiss | |
| 4,712,620 | A | 12/1987 | Lim et al. | |
| 5,305,839 | A | 4/1994 | Kalsi et al. | |
| 6,070,669 | A | 6/2000 | Radi et al. | |
| 7,198,098 | B2 | 4/2007 | Williams | |
| 7,308,954 | B2 | 12/2007 | Martin-Marshall | |
| 7,669,649 | B2 | 3/2010 | Williams | |
| 8,286,734 | B2 | 10/2012 | Hannegan et al. | |

(Continued)

FOREIGN PATENT DOCUMENTS

| | | |
|---|---|---|
| WO | 2011102737 A1 | 8/2011 |
| WO | 2017039434 A1 | 3/2017 |

OTHER PUBLICATIONS

International Search Report with Written Opinion dated Jun. 22, 2018 for PCT Patent Application No. PCT/US2018/021329, 15 pages.

*Primary Examiner* — Nicole Coy
*Assistant Examiner* — Yanick A Akaragwe
(74) *Attorney, Agent, or Firm* — Smith IP Services, P.C.

(57) ABSTRACT

A pressure control device can include an outlet, an inlet secured to well equipment, and a swivel mechanism that permits relative rotation between the outlet and the inlet in an unlocked configuration and prevents relative rotation between the outlet and the inlet in a locked configuration. A lock device of the swivel mechanism can include circumferentially distributed teeth, and an engagement member that engages at least one of the teeth in the locked configuration. A method of operating a pressure control device can include securing an inlet of the pressure control device to well equipment, rotating an outlet of the pressure control device about a longitudinal axis of the inlet, locking a swivel mechanism of the pressure control device, thereby preventing rotation of the outlet relative to the inlet, and sealing off an annulus surrounding a tubular string extending through the inlet.

18 Claims, 10 Drawing Sheets

(56) References Cited

U.S. PATENT DOCUMENTS

| | | | | |
|---|---|---|---|---|
| 9,004,181 | B2 | 4/2015 | Hannegan et al. | |
| 9,169,700 | B2 | 10/2015 | Cutris et al. | |
| 2002/0255783 | | 6/2002 | Regan | |
| 2006/0037782 | A1* | 2/2006 | Martin-Marshall | E21B 33/085 175/40 |
| 2007/0114039 | A1 | 5/2007 | Hobdy et al. | |
| 2011/0036638 | A1 | 2/2011 | Sokol et al. | |
| 2011/0233928 | A1 | 9/2011 | Olsen | |
| 2011/0233929 | A1 | 9/2011 | Olsen | |
| 2012/0255783 | A1 | 10/2012 | Curtis et al. | |
| 2017/0089155 | A1 | 3/2017 | Leuchtenberg | |

* cited by examiner

PRESSURE CONTROL DEVICE FOR USE WITH A SUBTERRANEAN WELL

BACKGROUND

This disclosure relates generally to equipment utilized and operations performed in conjunction with a subterranean well and, in an example described below, more particularly provides a pressure control device.

A pressure control device is typically used to seal off an annular space between an outer tubular structure (such as, a riser, a housing on a subsea structure in a riser-less system, or a housing attached to a surface wellhead) and an inner tubular (such as, a drill string, a test string, etc.), and to divert flow from the annular space to other well equipment. If an annular seal of the pressure control device can rotate with the inner tubular, the pressure control device may be referred to by those skilled in the art as a "rotating control device," a "rotating blowout preventer" or a "rotating drilling head." In some pressure control devices, the annular seal does not rotate with the inner tubular.

Therefore, it will be appreciated that advancements are continually needed in the arts of constructing and operating pressure control devices. These advancements could be implemented for various types of pressure control devices installed in conjunction with land-based or water-based rigs.

DETAILED DESCRIPTION

Figure 1:
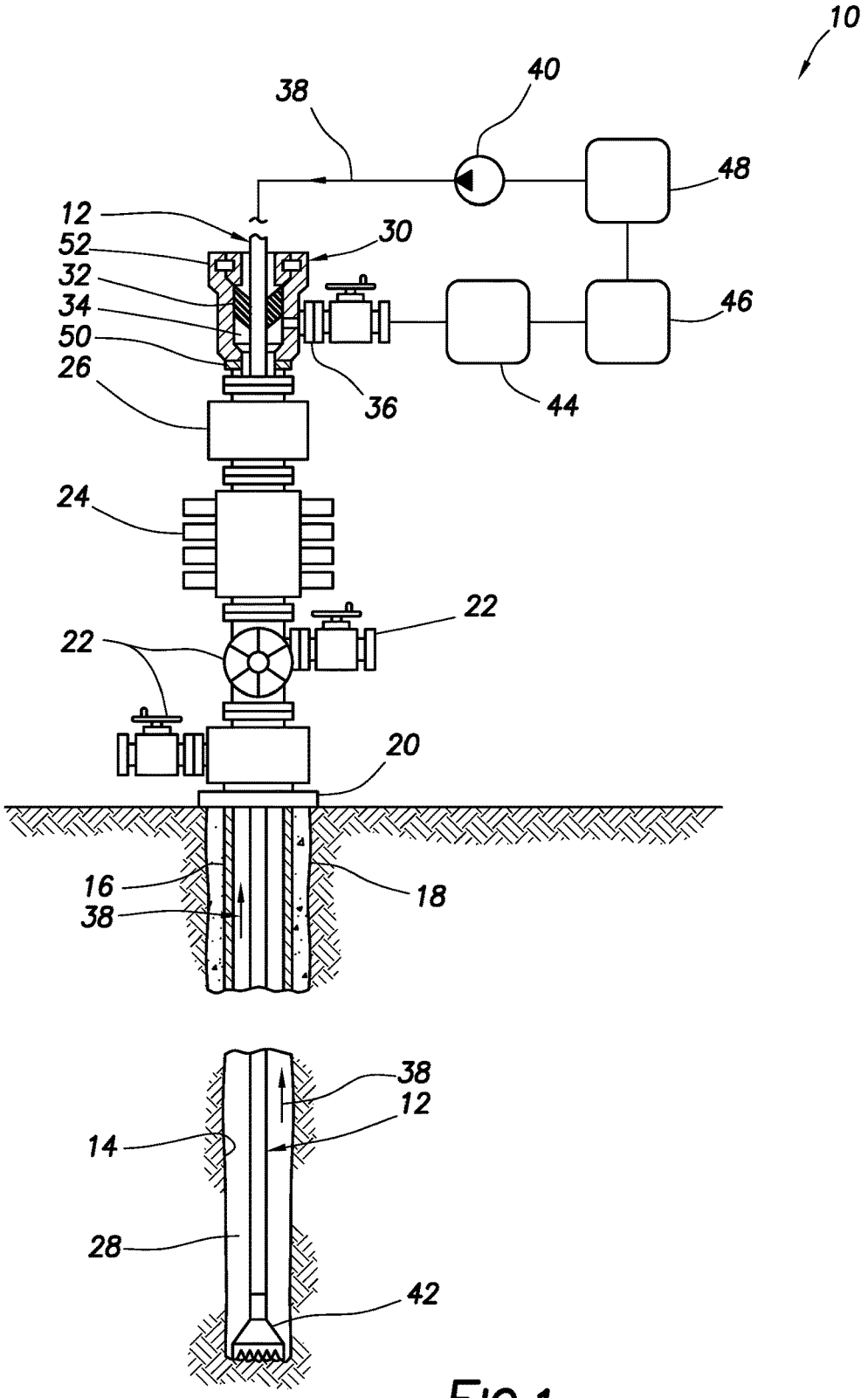
FIG. 1 is a representative partially cross-sectional view of an example of a well system and associated method which can embody principles of this disclosure.

Representatively illustrated in FIG. 1 is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the example depicted in FIG. 1, a tubular string 12 (such as, a drill string) is being used to drill a wellbore 14 into the earth. An upper section of the wellbore 14 is lined with casing 16 and cement 18. An annulus 28 is formed radially between the tubular string 12 and the wellbore 14.

At the earth's surface, the tubular string 12 extends through a wellhead 20. Various items of equipment are installed on the wellhead 20, including valves 22, a blowout preventer stack 24, an annular preventer 26 and a pressure control device 30.

In other examples, the wellhead 20 could be at a subsea location. Any of the valves 22, blowout preventer stack 24, annular preventer 26 and pressure control device 30 could be positioned at the subsea location, or they could be positioned above, at or below a water level, or on a rig or platform.

Thus, the scope of this disclosure is not limited to any of the specific details of the wellbore 14, the wellhead 20, the other items of equipment, locations of any of these elements, or configurations of these elements as described herein or depicted in the drawings. In addition, the scope of this disclosure is not limited to use of any particular number, combination or arrangement of equipment with a well.

In the FIG. 1 example, the pressure control device 30 includes an annular seal 32. The annular seal 32 could be in the form of a "stripper rubber" of the type well known to those skilled in the art. The annular seal 32 could be of the type known to those skilled in the art as "active" or "passive."

The annular seal 32 seals off and prevents flow through an annulus 34 surrounding the tubular string 12 in the pressure control device 30. However, the annulus 34 below the annular seal 32 is in communication with a lateral outlet 36. The annulus 34 is also in communication with the annulus 28 downhole.

In one example of a drilling operation, drilling fluid 38 can be circulated (e.g., using a "mud" pump or rig pump 40 at surface) through the tubular string 12, into the annulus 28 (such as, via nozzles in a drill bit 42), and then via the annulus 28 to the wellhead 20. Drilling fluid 38 that flows to the annulus 34 is prevented by the annular seal 32 from flowing further longitudinally upward, and so the fluid 38 is instead diverted laterally through the outlet 36 to other well equipment.

The well equipment connected to the outlet 36 can include flow control and measurement devices 44 (such as, chokes, valves, flowmeters, pressure and temperature sensors, etc.), separation devices 46 (such as, gas and solids separators) and fluid conditioning devices 48 (such as, weighting and fluid loss control additives, etc.). The conditioned drilling fluid 38 is returned to the pump 40 for re-circulation through the tubular string 12 and annuli 28, 34 during the drilling operation.

In a technique known to those skilled in the art as "managed pressure drilling," the circulation of the drilling fluid 38 is essentially "closed loop." Pressure in the wellbore 14 downhole can be controlled by means other than varying a weight of the drilling fluid 38 or friction due to the fluid flow. For example, with the drilling fluid 38 being circulated by the pump 40 in the FIG. 1 system 10, pressure in the annulus 28 downhole can be increased by restricting return flow of the fluid 38 at surface (e.g., downstream of the outlet 36, using a choke of the devices 44). Similarly, by reducing the restriction to return flow of the fluid 38 at surface, pressure in the annulus 28 downhole can be decreased.

Note that it is not necessary, in keeping with the principles of this disclosure, for a managed pressure drilling operation to be performed, or for pressure in the annulus 28 to be controlled by variably restricting return flow of the drilling fluid 38. The scope of this disclosure is not limited to any particular type of drilling operation in which the pressure control device 30 is used.

In the FIG. 1 example, the pressure control device 30 is connected above the annular preventer 26, and the outlet 36 faces to the right (as depicted in FIG. 1) and toward certain well equipment (such as, the flow control and measurement devices 44). Thus, for convenient and quick installation of the pressure control device 30, it would be desirable for the pressure control device to be readily connectable to the annular preventer 26, and for the outlet 36 to be facing appropriately toward the well equipment for connection thereto, while the pressure control device is appropriately aligned with the annular preventer for connection thereto.

As depicted in FIG. 1, the pressure control device 30 includes a swivel mechanism 50 that permits an outer body 52 of the pressure control device to rotate relative to a lower inlet connection. The swivel mechanism 50 includes a lock device (see FIGS. 5 & 6, described more fully below) that secures the body 52 against rotation relative to the lower inlet connection, for example, when the outlet 36 is appropriately aligned with other well equipment.

Figure 2:
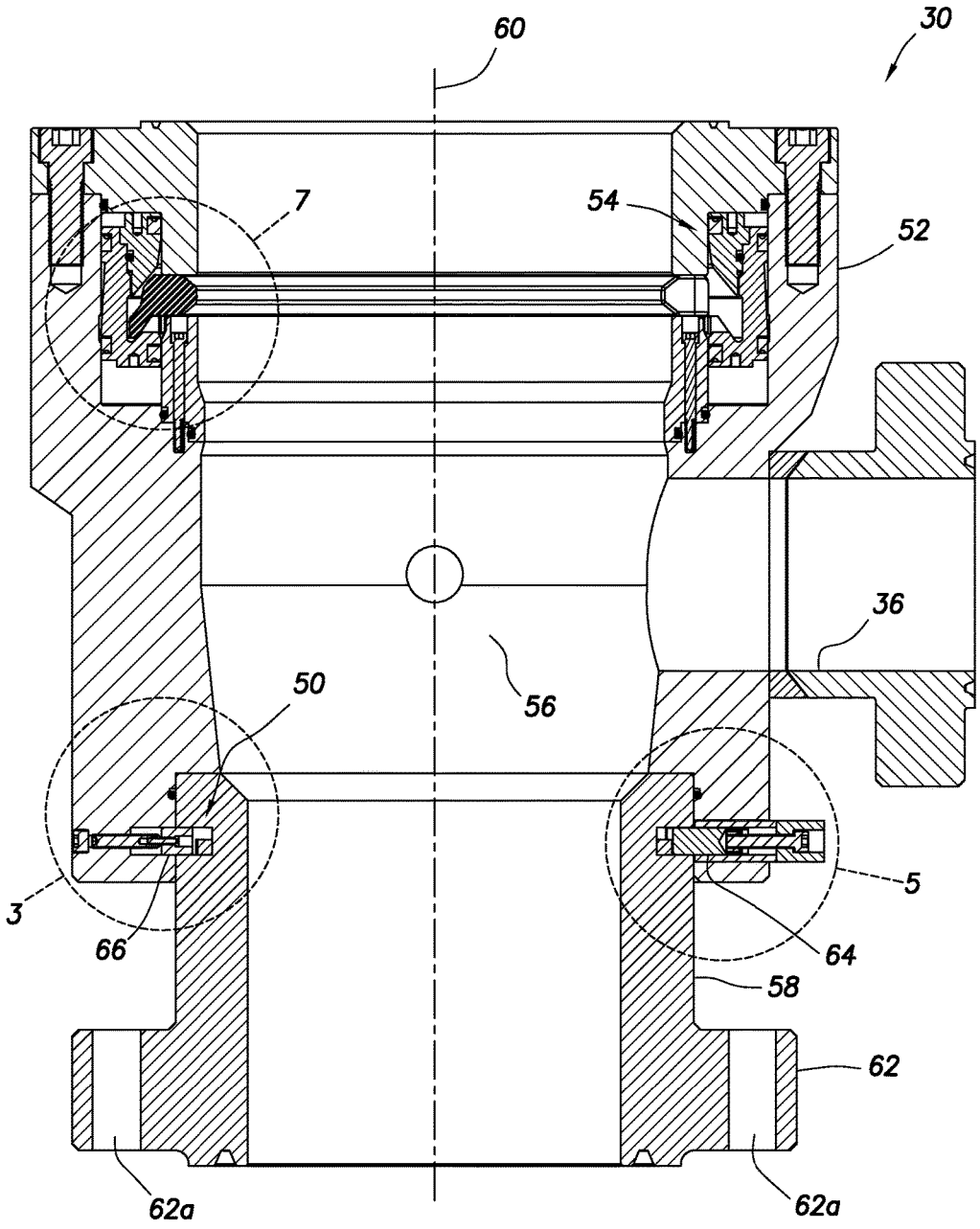
FIG. 2 is a representative cross-sectional view of an example of a pressure control device that may be used in the FIG. 1 system and method, and which can embody the principles of this disclosure.

Referring additionally now to FIG. 2, a cross-sectional view of an example of the pressure control device 30 is representatively illustrated. For convenience, the pressure control device 30 is described below as used with the system 10 and method of FIG. 1, but it should be clearly understood that the pressure control device may be used with other systems and methods, in keeping with the principles of this disclosure.

As depicted in FIG. 2, the annular seal 32 (see FIGS. 1, 8 & 9) is not installed in the pressure control device 30, for convenience of illustration. However, a latch 54 is provided for releasably securing the annular seal 32 in the body 52 in response to pressure applied to the latch.

In other examples, the latch 54 could be combined with components (such as, the annular seal 32) that are releasably secured by the latch in the body 52. In still further examples, the latch 54 could be actuated by means other than pressure (e.g., an electrical actuator could be used). Thus, the scope of this disclosure is not limited to any particular details of the latch 54 as described herein or depicted in the drawings.

In the FIG. 2 example, a central passage 56 extends longitudinally through the body 52. The outlet 36 intersects and extends laterally relative to the body 52 and the passage 56. In some examples, the outlet 36 may not necessarily be exactly orthogonal to the passage 56, but may instead be inclined or angled relative to the body 52.

The passage 56 also extends longitudinally through an inlet 58. The swivel mechanism 50 rotatably connects the body 52 and the inlet 58, so that relative rotation is permitted between the body and the inlet about a longitudinal axis 60.

In this manner, a connector 62 of the inlet 58 can be rotationally aligned with certain well equipment (such as, the annular preventer 26), while the outlet 36 is also rotationally aligned with other well equipment (such as, the flow control and measurement devices 44).

As depicted in FIG. 2, the connector 62 is in the form of a flange having circumferentially distributed bolt holes 62*a*. The circumferential spacing between the bolt holes 62*a* determines a fixed number of separate rotational orientations of the connector 62 relative to the item of equipment (such as, the annular preventer 26 in the FIG. 1 system 10) to which the connector is attached. The annular preventer 26 in this example has an upper connector in the form of a flange similar to, or at least operatively connectable to, the connector 62 flange.

In other examples, the connector 62 may not be in the form of a flange. A threaded connection, for example, could be used to connect the inlet 58 to well equipment (such as, the annular preventer 26).

If the inlet 58 (including the connector 62), the body 52 and the outlet 36 were permanently fixed in their relative rotational orientations, then the outlet 36 would also have a fixed number of separate rotational orientations relative to the item of equipment (such as, the flow control and measurement devices 44 in the FIG. 1 system 10) to which the outlet is attached. Unfortunately, installation of the pressure control device 30 is made more difficult if one of the fixed number of rotational orientations does not result in the outlet 36 being aligned with the equipment to which it is to be connected.

In the FIG. 2 example, however, relative rotation between the body 52 and the inlet 58 is provided for by the swivel mechanism 50. Thus, the lower connector 62 can be appropriately rotationally aligned for connection to an item of equipment by rotating the inlet 58 about the longitudinal axis 60 relative to the body 52, and the outlet 36 can be rotationally aligned for connection to another item of equipment by rotating the body 52 relative to the inlet 58 about the longitudinal axis 60. As described more fully below with regard to FIGS. 5 & 6, the swivel mechanism 50 can include a lock device 64 for locking the body 52 and inlet 58 in a relative rotational orientation in which the inlet 58 and outlet 36 are appropriately aligned with the equipment to which they are connected.

Figure 3:
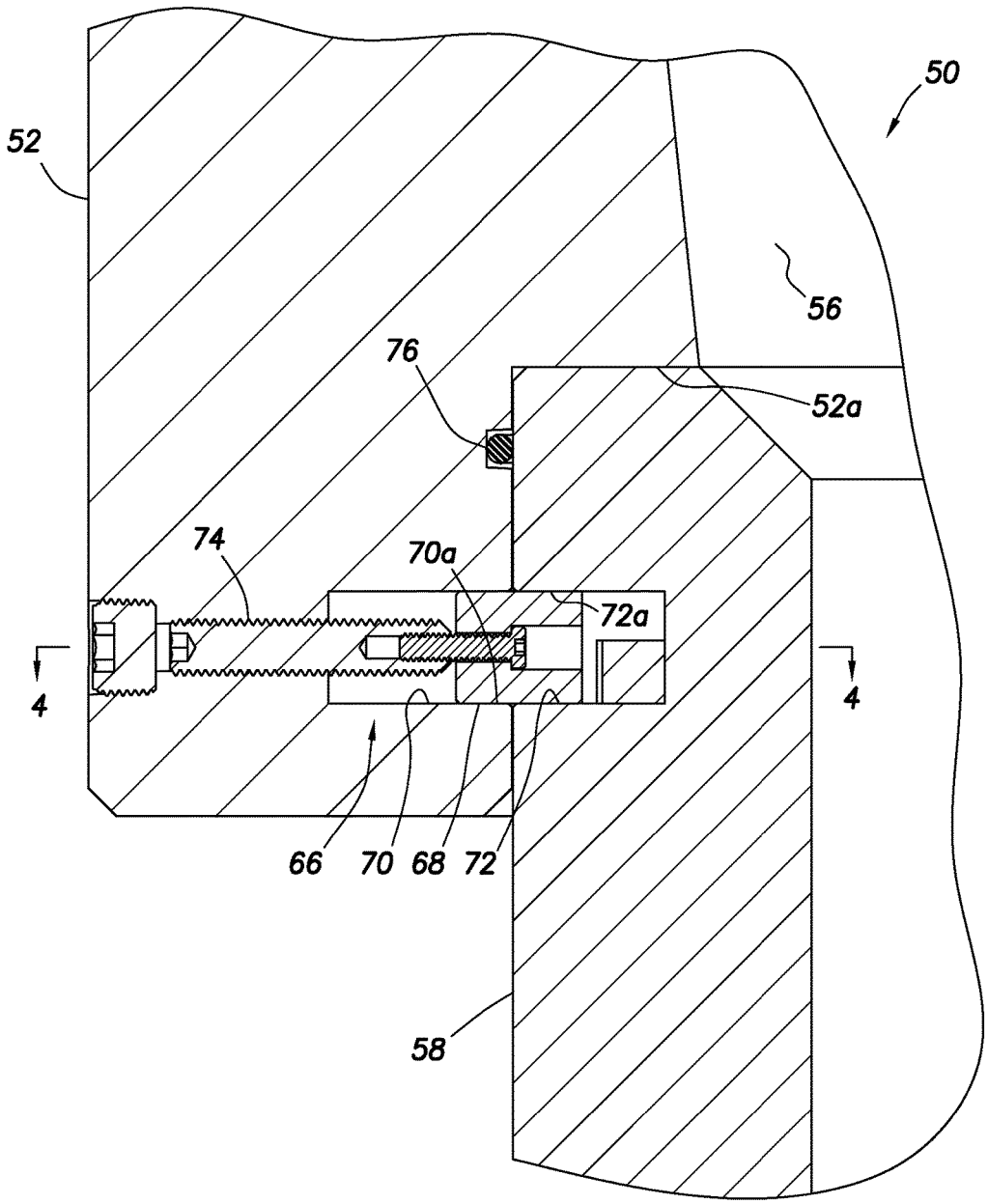
FIG. 3 is a representative cross-sectional view of an example of a rotary coupling of the pressure control device, corresponding to detail 3 of FIG. 2.
Figure 4:
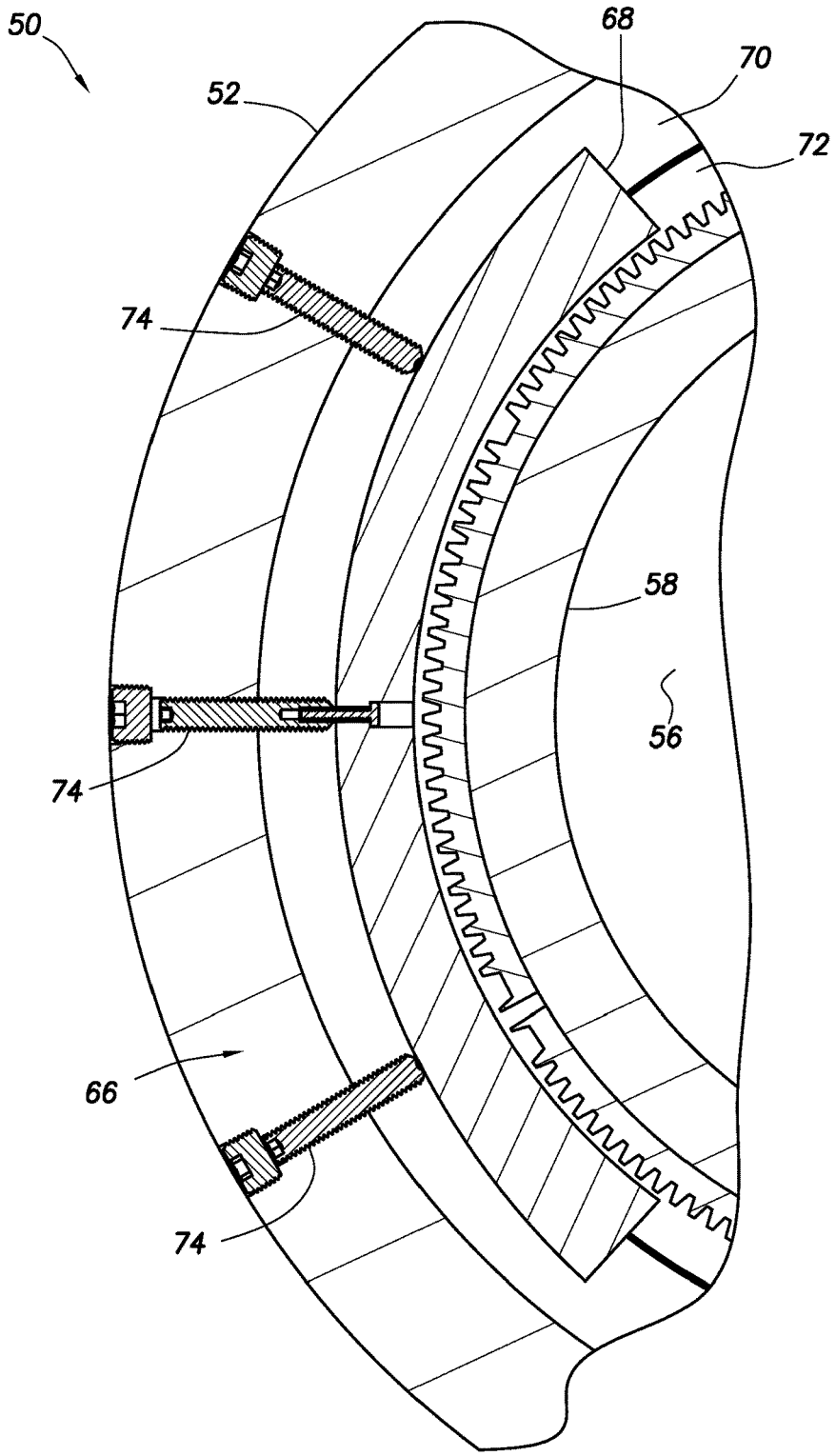
FIG. 4 is a representative cross-sectional view of the rotary coupling, taken along line 4-4 of FIG. 3.

The swivel mechanism 50 also includes a rotary coupling 66 for permitting relative rotation between the body 52 and the inlet 58, but preventing significant relative longitudinal displacement between the body 52 and the inlet. FIG. 3 depicts a larger scale cross-sectional view of this example of the rotary coupling 66, corresponding to detail 3 of FIG. 2. FIG. 4 depicts a lateral cross-sectional view of the rotary coupling 66, taken along line 4-4 of FIG. 3.

The rotary coupling 66 example of FIGS. 3 & 4 includes multiple radially displaceable lugs 68 received in annular recesses 70, 72 formed in the respective body 52 and inlet 58. The lugs 68 in this example are arc-shaped for complementary engagement with the annular-shaped recesses 70, 72. However, the scope of this disclosure is not limited to any particular shapes, configurations or arrangements of the lugs 68 or recesses 70, 72.

As depicted in FIGS. 3 & 4, the lugs 68 are engaged with both of the recesses 70, 72. In this position, the lugs 68 prevent substantial relative longitudinal displacement between the body 52 and the inlet 58. In some examples, the relative longitudinal displacement may be limited to that allowed for by normal manufacturing tolerances and clearances for the various components of the rotary coupling 66.

The lugs 68 are positioned between oppositely facing shoulders 70*a*, 72*a* of the respective recesses 70, 72, thereby preventing longitudinal separation of the body 52 and inlet 58. The inlet 58 engages a shoulder 52*a* in the body 52, thereby preventing the inlet from being received further in the body. Alternatively, engagement between the lugs 68 and the recesses 70, 72 could limit the distance the inlet 58 can be received in the body 52.

The lugs 68 can be radially retracted into the recess 70 in the body 52 using threaded fasteners 74 or other types of actuators. In the FIGS. 3 & 4 example, the fasteners 74 can be rotated to thereby radially outwardly displace the lugs 68 further into the recess 70, and out of the recess 72. The lugs 68 are, in this manner, disengaged from the recess 72 and inlet 58.

The body 52 and inlet 58 can be assembled and disassembled while the lugs 68 are disengaged from the recess 72. When it is desired to connect the body 52 and the inlet 58, the fasteners 74 can be rotated to thereby radially inwardly displace the lugs 68 into engagement with the recess 72.

A seal 76 isolates the passage 56 from the rotary coupling 66 and the exterior of the pressure control device 30. Note that other types of rotary couplings may be used in the swivel mechanism 50, in keeping with the principles of this disclosure.

Figure 5:
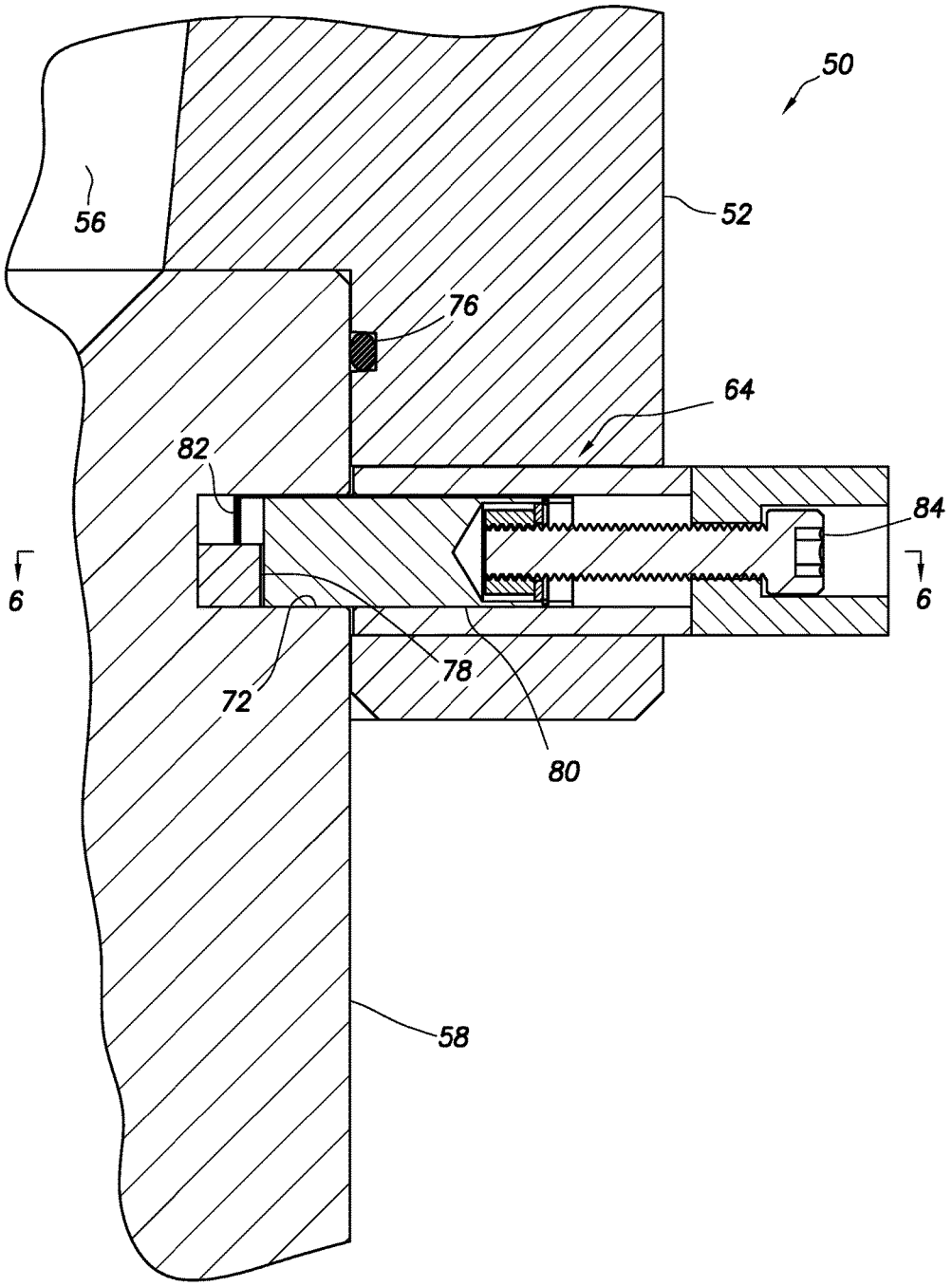
FIG. 5 is a representative cross-sectional view of an example of a lock device of the pressure control device, corresponding to detail 5 of FIG. 2.
Figure 6:
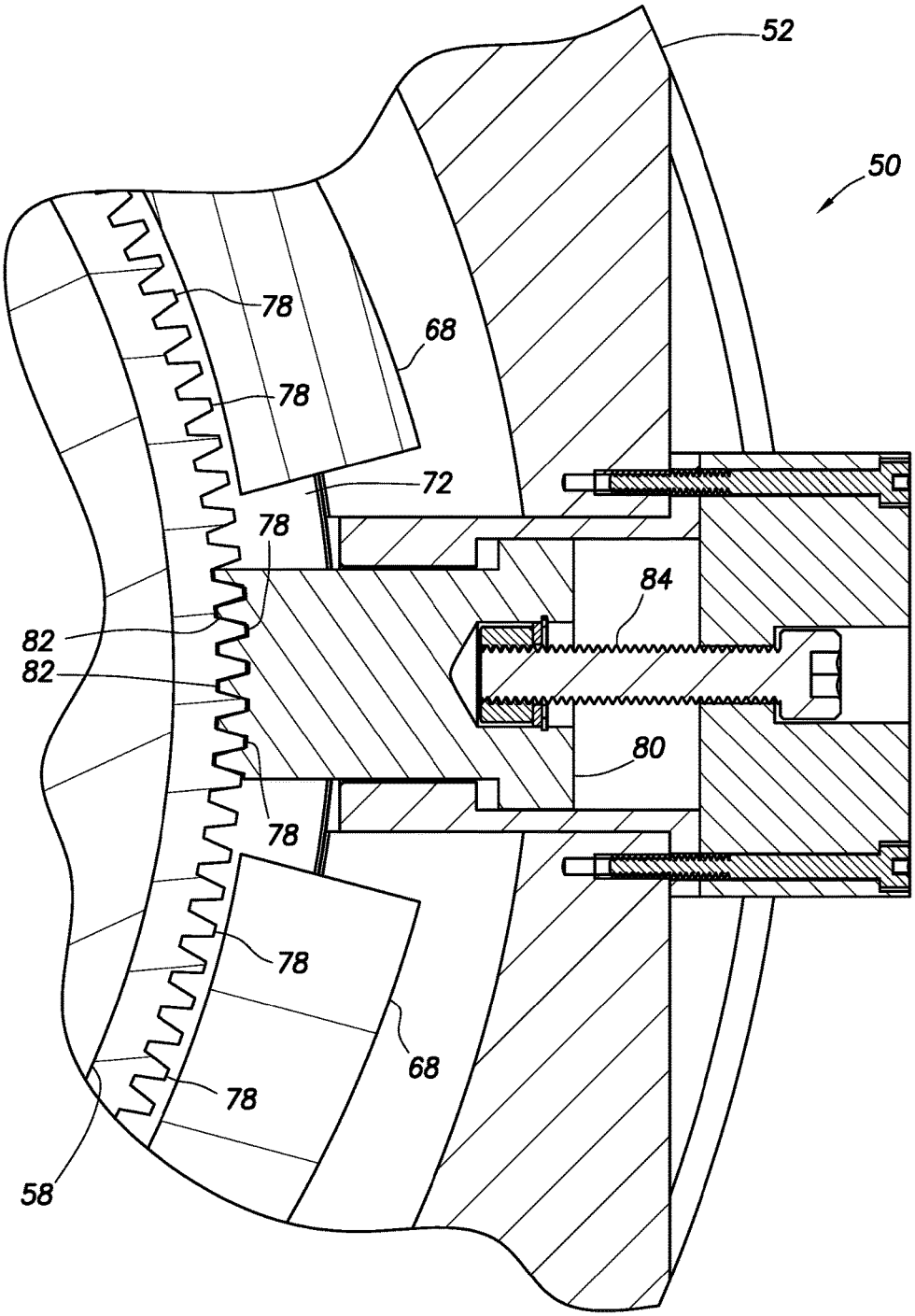
FIG. 6 is a representative cross-sectional view of the lock device, taken along line 6-6 of FIG. 5.

Referring additionally now to FIG. 5, a cross-sectional view of an example of the lock device 64 is representatively illustrated, corresponding to detail 5 of FIG. 2. FIG. 6 is a lateral cross-sectional view of the lock device 64, taken along line 6-6 of FIG. 5.

The lock device 64 in this example includes a series of circumferentially distributed teeth 78 secured to the inlet 58, and an engagement member 80 that is radially displaceable relative to the body 52. The engagement member 80 has an engaged position, in which the engagement member is engaged with one or more of the teeth 78 and relative rotation between the body 52 and inlet 58 is prevented, and a disengaged position, in which the engagement member is not engaged with any of the teeth 78 and relative rotation between the body 52 and inlet 58 is permitted.

The teeth 78 in this example are in the form of a segmented ring gear, with the teeth 78 corresponding to the gear teeth. In other examples, the teeth 78 could be separate structures, the teeth could be in the form of projections, recesses, grooves or any other structures that can be circumferentially distributed and engaged by another member to fix the relative rotational orientation between the body 52 and the inlet 58.

The engagement member 80 in this example has teeth 82 formed thereon for complementary engagement with the teeth 78. The engagement member 80 can be displaced radially by rotating a threaded fastener 84.

In a locked configuration, as depicted in FIGS. 5 & 6, the engagement member 80 is displaced radially inward into engagement with one or more of the teeth 78, and relative rotation between the body 52 and the inlet 58 is prevented. In an unlocked configuration, the engagement member 80 is displaced radially outward and out of engagement with any of the teeth 78, and relative rotation between the body and the inlet is permitted.

Figure 7:
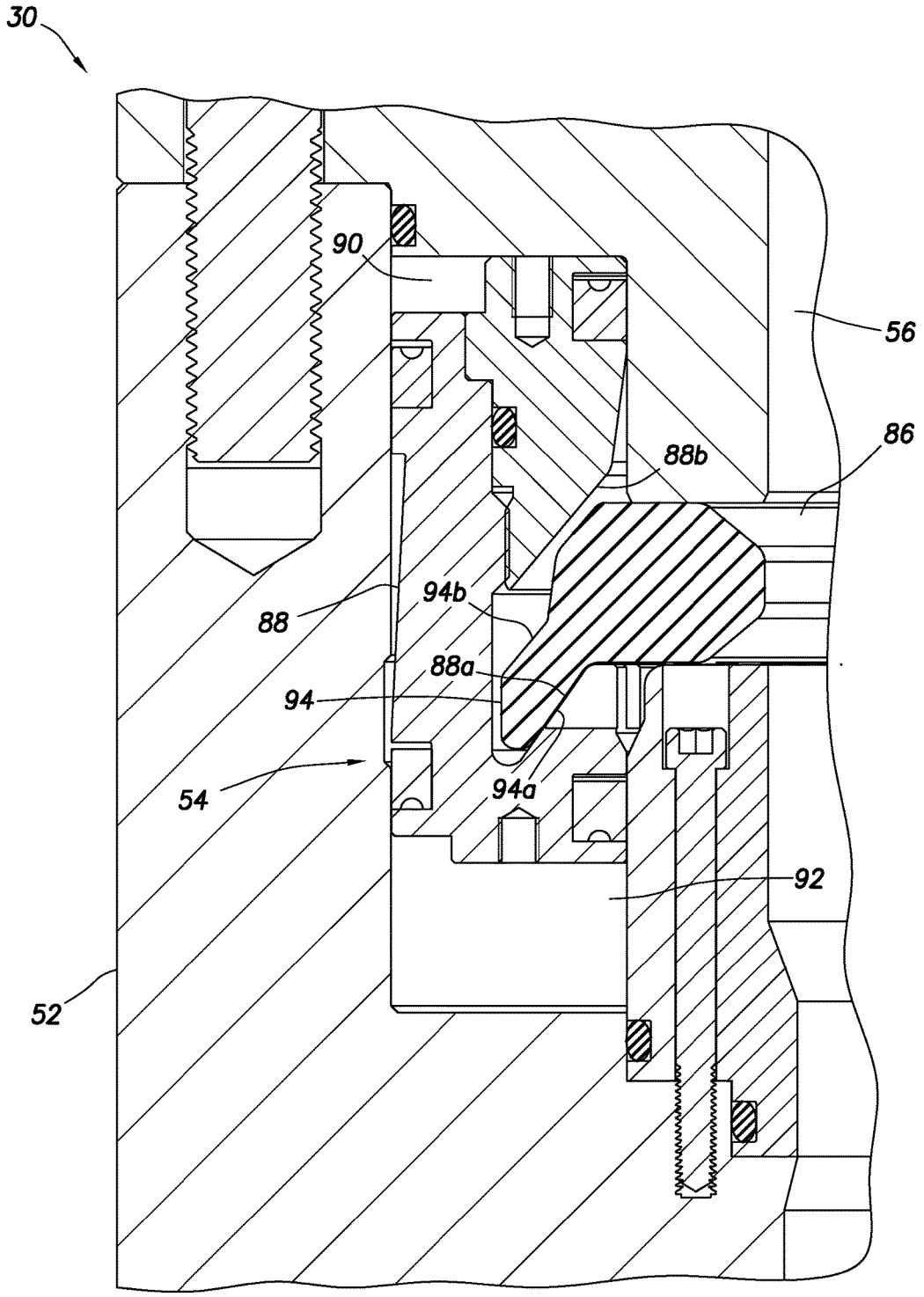
FIG. 7 is a representative cross-sectional view of an example of a latch of the pressure control device, corresponding to detail 7 of FIG. 2.

Referring additionally now to FIG. 7, a cross-sectional view of an example of the latch 54 is representatively illustrated, corresponding to view 7 of FIG. 2. The latch 54 may be used with the pressure control device 30 of FIGS. 2-6, or it may be used with other pressure control devices.

As depicted in FIG. 7, the latch 54 includes a radially displaceable split ring 86 coupled to an annular latch piston 88. The piston 88 is longitudinally reciprocable in the body 52 between fluid chambers 90, 92.

When the piston 88 is displaced upward (as viewed in FIG. 7) to its unlatched position, the split ring 86 is radially outwardly expanded, so that the annular seal 32 and/or other components can be installed in, or retrieved from, the pressure control device 30. The piston 88 can be displaced to the unlatched position by applying increased pressure to the lower chamber 92 (such as, using a hydraulic pump or other pressure source).

When the piston 88 is displaced downward (as viewed in FIG. 7) to its latched position, the split ring 86 is radially inwardly contracted, so that the annular seal 32 and/or other components are releasably secured in the pressure control device 30. The piston 88 can be displaced to the unlatched position by applying increased pressure to the upper chamber 90.

The split ring 86 has an extension 94 with oppositely facing inclined surfaces 94*a*, 94*b* formed thereon. When the piston 88 displaces to its unlatched position, the split ring inclined surface 94*a* engages an inclined surface 88*a* of the piston, which engagement biases the split ring 86 to displace radially outward. When the piston 88 displaces to its latched position, the split ring inclined surface 94*b* engages an inclined surface 88*b* of the piston, which engagement biases the split ring 86 to displace radially inward.

Figure 8:
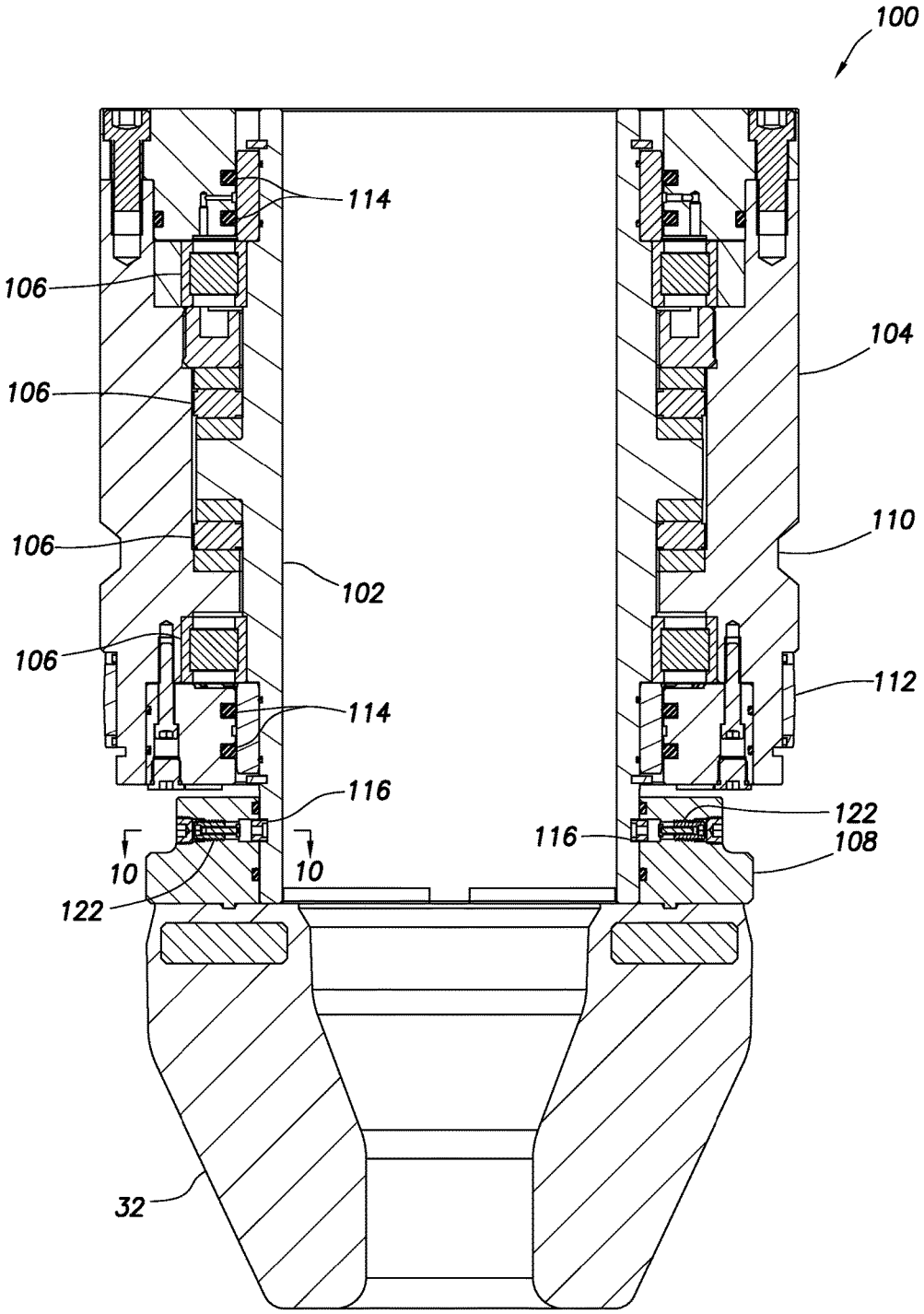
FIG. 8 is a representative cross-sectional view of an example of a replaceable assembly of the pressure control device.
Figure 9:
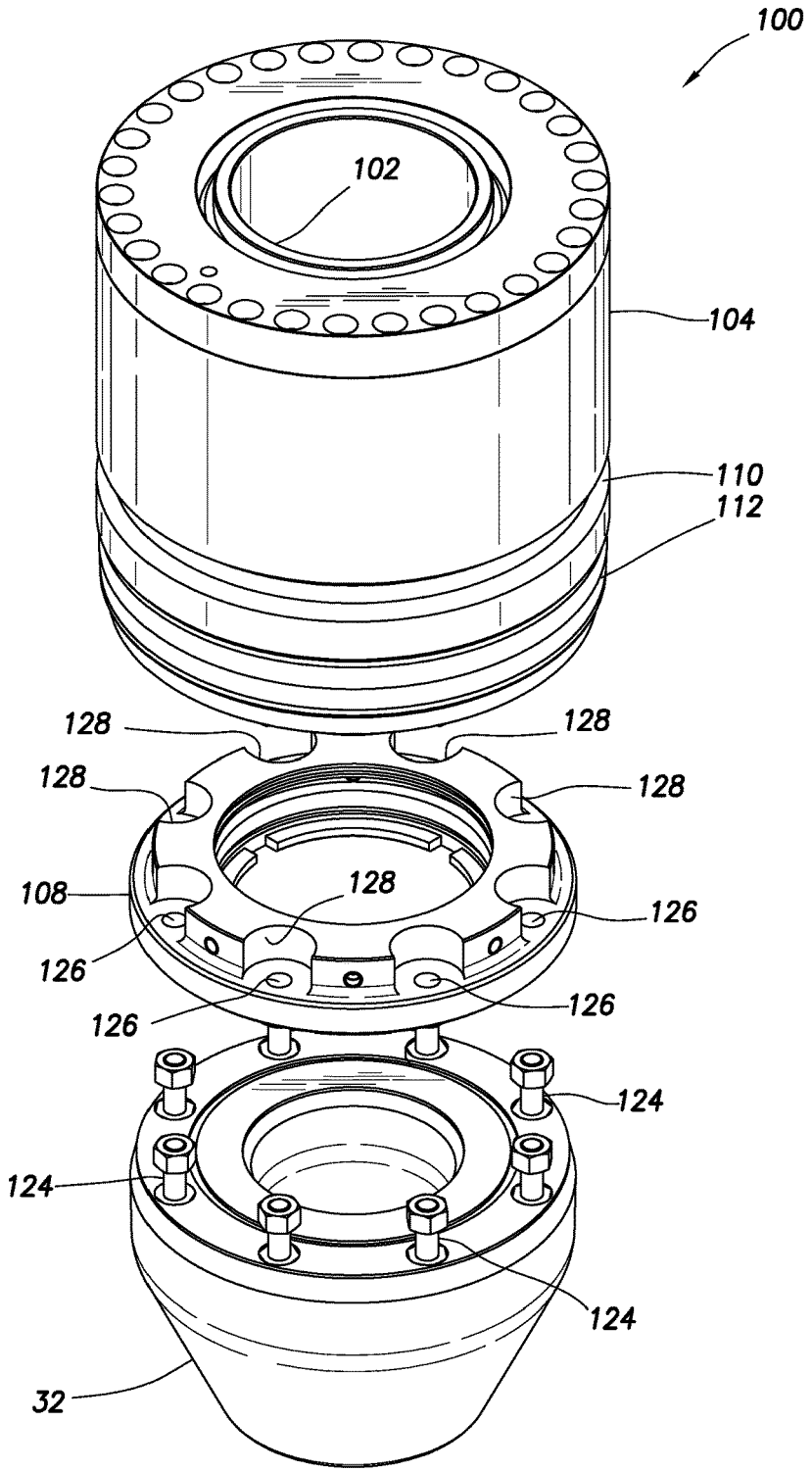
FIG. 9 is a representative exploded view of the replaceable assembly.

Referring additionally now to FIGS. 8 & 9, an example of a replaceable assembly 100 is representatively illustrated. The replaceable assembly 100 may be used with the pressure control device 30, or it may be used with other pressure control devices.

As depicted in FIGS. 8 & 9, the replaceable assembly 110 includes the annular seal 32, an inner rotatable mandrel 102, an outer housing 104 and bearings 106. The bearings 106 permit the inner mandrel 102 to rotate relative to the outer housing 104. The annular seal 32 is secured to the inner mandrel 102 by an attachment collar 108.

The outer housing 104 has an annular recess 110 formed thereon. The recess 110 is configured for complementary engagement by the split ring 86 (see FIG. 7) to releasably secure the replaceable assembly 110 in the pressure control device 30.

When the split ring 86 is displaced radially inward, as described above, into engagement with the recess 110, the replaceable assembly 110 is secured in the pressure control device 30. When the split ring 86 is displaced radially outward, as described above, out of engagement with the recess 110, the replaceable assembly 110 is released for retrieval from the pressure control device 30.

A seal 112 seals between the body 52 and the outer housing 104 when the replaceable assembly 110 is received in the body 52. Seals 114 seal between the outer housing 104 and the inner mandrel 102.

Figure 10:
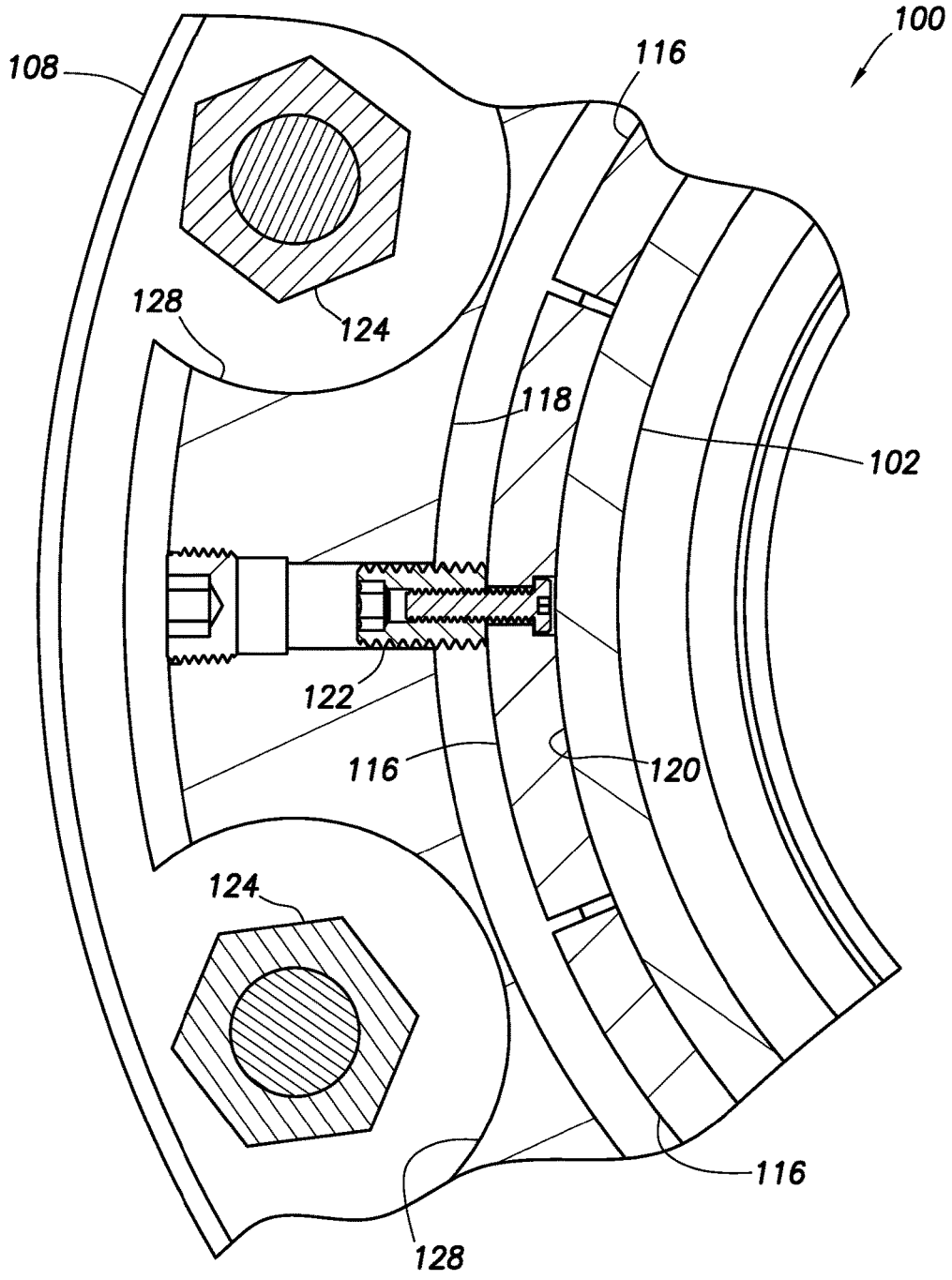
FIG. 10 is a representative cross-sectional view of a collar attachment of the releasable assembly, taken along line 10-10 of FIG. 8.

The collar 108 is secured to the inner mandrel 102 with multiple radially displaceable lugs 116 received in annular recesses 118, 120 formed in the respective collar 108 and inner mandrel 102 (see FIG. 10). The lugs 116 in this example are arc-shaped for complementary engagement with the annular-shaped recesses 118, 120. However, the scope of this disclosure is not limited to any particular shapes, configurations or arrangements of the lugs 116 or recesses 118, 120.

As depicted in FIGS. 8 & 10, the lugs 116 are engaged with both of the recesses 118, 120. In this position, the lugs 116 prevent substantial relative longitudinal displacement between the collar 108 and the inner mandrel 102. In some examples, the relative longitudinal displacement may be limited to that allowed for by normal manufacturing tolerances and clearances for the lugs 116 and recesses 118, 120.

The lugs 116 can be radially retracted into the recess 118 in the collar 108 using threaded fasteners 122 or other types of actuators. In the FIGS. 8-10 example, the fasteners 122 can be rotated to thereby radially outwardly displace the lugs 116 further into the recess 118, and out of the recess 120. The lugs 116 are, in this manner, disengaged from the recess 120 and inner mandrel 102.

The collar 108 and inner mandrel 102 can be assembled and disassembled while the lugs 116 are disengaged from the recess 120. When it is desired to connect the collar 108 and the inner mandrel 102, the fasteners 122 can be rotated to thereby radially inwardly displace the lugs 116 into engagement with the recess 120.

The annular seal 32 is attached to the collar 108 with bolts or other fasteners 124 that extend through circumferentially distributed holes 126 in the collar 108 (see FIG. 9). The fasteners 124 are also received in respective circumferentially distributed recesses 128 formed in the collar 108.

Note that the arrangement of the collar 108 with the lugs 116, recesses 118, 120, fasteners 124 and recesses 128 provides a vertically compact configuration. This allows the overall pressure control device 30 to be vertically shorter, thereby saving expense in construction of the pressure control device, and saving vertical space at a well installation.

It may now be fully appreciated that the above disclosure provides significant advancements to the arts of designing, constructing and utilizing pressure control devices with subterranean wells. In one aspect, the swivel mechanism 50 with the lock device 64 provides for convenience, speed and enhanced adjustability in rotationally aligning the inlet 58 and outlet 36 with well equipment. In another aspect, the latch 54 provides for reliable and convenient securement of the annular seal 32 and/or other components (such as, bearings if the seal is rotatable) in the pressure control device 30. The swivel mechanism 50, the latch 54 and the seal attachment collar 108 are, in examples described above, longitudinally compact, so that an overall vertical height of the pressure control device 30 can be reduced.

The above disclosure provides to the art a pressure control device 30 for use with a subterranean well. In one example, the pressure control device 30 can include a body 52 having a central longitudinal passage 56, and a laterally extending outlet 36 in communication with the passage 56, an annular seal 32 secured to the body 52 and configured to seal off an annulus 34 surrounding a tubular string 12 in the passage 56, an inlet 58 longitudinally aligned and in communication with the passage 56, and a swivel mechanism 50 having locked and unlocked configurations. The swivel mechanism 50 permits relative rotation between the body 52 and the inlet 58 about a common longitudinal axis 60 in the unlocked configuration, and the swivel mechanism 50 prevents relative rotation between the body 52 and the inlet 58 in the locked configuration.

The swivel mechanism 50 may comprises a lock device 64 including a series of circumferentially distributed teeth 78 and an engagement member 80, the engagement member 80 engaging the teeth 78 in the locked configuration, and the engagement member 80 being disengaged from the teeth 78 in the unlocked configuration.

The teeth 78 may be secured to the inlet 58. The engagement member 80 may be rotatable with the body 52 relative to the inlet 58 in the unlocked configuration.

The swivel mechanism 50 may include a rotary coupling 66 that substantially prevents relative longitudinal displacement between the body 52 and the inlet 58, but permits relative rotational displacement between the body 52 and the inlet 58. The rotary coupling 66 may comprise one or more radially displaceable lugs 68 received in recesses 70, 72 in the body 52 and the inlet 58.

The pressure control device 30 may include a collar 108 attached to the annular seal 32, and radially displaceable lugs 116 that releasably attach the collar 108 to an inner mandrel 102 of a replaceable assembly 100. The collar 108 may be attached to the annular seal 32 with fasteners 124, the fasteners 124 extending through holes 126 formed through the collar 108. The fasteners 124 may be received in recesses 128 adjacent respective ones of the holes 126.

A method of operating a pressure control device 30 with a subterranean well is also provided to the art by the above disclosure. In one example, the method can include securing an inlet 58 of the pressure control device 30 to well equipment (such as, the annular preventer 26), rotating an outlet 36 of the pressure control device 30 about a longitudinal axis 60 of the inlet 58, locking a swivel mechanism 50 of the pressure control device 30, thereby preventing rotation of the outlet 36 relative to the inlet 58, and sealing off an annulus 34 surrounding a tubular string 12 extending through the inlet 58.

The rotating step may include rotating the outlet 36 relative to the inlet 58 while the inlet 58 is secured to the well equipment.

The locking step may include displacing an engagement member 80 into engagement with at least one of multiple circumferentially distributed teeth 78. The displacing step may include displacing the engagement member 80 radially relative to the inlet 58.

The method may include securing the inlet 58 to a body 52 of the pressure control device 30 by displacing one or more lugs 68 into a position in which the lugs 68 prevent substantial relative longitudinal displacement between the body 52 and the inlet 58, but permit relative rotation between the body 52 and the inlet 58.

The outlet 36 may extend laterally from the body 52. The outlet 36 is in communication with a passage 56 extending longitudinally through the body 52.

The method may include latching an annular seal 32 as part of a replaceable assembly 100 of the pressure control device 30. The attaching step can comprise radially displacing one or more lugs 116 into engagement with an annular recess 120 formed on an inner mandrel 102 of the replaceable assembly 100.

A well system 10 is also described above. In one example, the well system 10 can comprise a pressure control device 30 including an annular seal 32 that seals off an annulus 34 surrounding a tubular string 12 extending longitudinally through the pressure control device 30. The pressure control device 30 further includes an outlet 36, an inlet 58 secured to well equipment (such as, the annular preventer 26), and a swivel mechanism 50 that permits relative rotation between the outlet 36 and the inlet 58 in an unlocked configuration and prevents relative rotation between the outlet 36 and the inlet 58 in a locked configuration. The swivel mechanism 50 includes circumferentially distributed teeth 78, and an engagement member 80 that engages at least one of the teeth 78 in the locked configuration.

The engagement member 80 is disengaged from the teeth 78 in the unlocked configuration, and the engagement member 80 displaces radially relative to the inlet 58 between engagement and disengagement with the teeth 78.

The swivel mechanism 50 comprises a rotary coupling 66 that substantially prevents relative longitudinal displacement between the outlet 36 and the inlet 58, but permits relative rotational displacement between the outlet 36 and the inlet 58. The rotary coupling 66 may comprise one or more radially displaceable lugs 68 received in a recess 72 in the inlet 58.

Although various examples have been described above, with each example having certain features, it should be understood that it is not necessary for a particular feature of one example to be used exclusively with that example.

Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A pressure control device for use with a subterranean well, the pressure control device comprising:

a body having a central longitudinal passage, and the body having a laterally extending outlet in communication with the passage;

an annular seal secured to the body and configured to seal off an annulus surrounding a tubular string in the passage;

an inlet longitudinally aligned with, and in communication with, the passage; and a swivel mechanism having locked and unlocked configurations, the swivel mechanism permitting relative rotation between the body and the inlet about a common longitudinal axis in the unlocked configuration, and the swivel mechanism preventing relative rotation between the body and the inlet in the locked configuration, in which the swivel mechanism comprises a rotary coupling that permits relative rotational displacement between the body and the inlet, but prevents relative longitudinal displacement between the body and the inlet.

2. The pressure control device of claim 1, in which the swivel mechanism further comprises a lock device including a series of circumferentially distributed teeth and an engagement member, the engagement member engaging the teeth in the locked configuration, and the engagement member being disengaged from the teeth in the unlocked configuration.

3. The pressure control device of claim 2, in which the teeth are secured relative to the inlet, and the engagement member is rotatable with the body relative to the inlet in the unlocked configuration.

4. The pressure control device of claim 1, in which the rotary coupling comprises one or more radially displaceable lugs received in recesses in the body and the inlet.

5. The pressure control device of claim 1, further comprising a collar attached to the annular seal, and radially displaceable lugs that releasably attach the collar to an inner mandrel of a replaceable assembly.

6. The pressure control device of claim 5, in which the collar is attached to the annular seal with fasteners, the fasteners extending through holes formed through the collar, and in which the fasteners are received in recesses adjacent respective ones of the holes.

7. A method of operating a pressure control device with a subterranean well, the method comprising:

securing an inlet of the pressure control device to an item of well equipment;

then rotating an outlet of the pressure control device about a longitudinal axis of the inlet;

locking a swivel mechanism of the pressure control device, thereby preventing rotation of the outlet relative to the inlet, in which the locking comprises displacing an engagement member into engagement with at least one of multiple circumferentially distributed teeth; and sealing off an annulus surrounding a tubular string extending through the inlet.

8. The method of claim 7, in which the rotating comprises rotating the outlet relative to the inlet while the inlet is secured to the item of well equipment.

9. The method of claim 7, in which the displacing comprises displacing the engagement member radially relative to the inlet.

10. The method of claim 7, further comprising securing the inlet to a body of the pressure control device by displacing one or more lugs into a position in which the lugs prevent substantial relative longitudinal displacement between the body and the inlet, but permit relative rotation between the body and the inlet.

11. The method of claim 7, in which the outlet extends laterally from the body, and in which the outlet is in communication with a passage extending longitudinally through the body.

12. The method of claim 7, further comprising attaching an annular seal as part of a replaceable assembly of the pressure control device, the attaching comprising radially displacing one or more lugs into engagement with an annular recess formed on an inner mandrel of the replaceable assembly.

13. A well system, comprising:

a pressure control device including an annular seal that seals off an annulus surrounding a tubular string extending longitudinally through the pressure control device, the pressure control device further including an outlet, an inlet secured to an item of well equipment, and a swivel mechanism that permits relative rotation between the outlet and the inlet in an unlocked configuration and prevents relative rotation between the outlet and the inlet in a locked configuration, the swivel mechanism including circumferentially distributed teeth, and an engagement member that engages at least one of the teeth in the locked configuration, in which the engagement member displaces radially relative to the inlet between engagement and disengagement with the at least one of the teeth.

14. The well system of claim 13, in which the outlet extends laterally from a body of the pressure control device, and in which the outlet is in communication with a passage extending longitudinally through the body.

15. The well system of claim 13, in which the engagement member is disengaged from the teeth in the unlocked configuration.

16. The well system of claim 13, in which the teeth are secured to the inlet, and the engagement member is rotatable with the outlet relative to the inlet in the unlocked configuration.

17. The well system of claim 13, in which the swivel mechanism comprises a rotary coupling that substantially prevents relative longitudinal displacement between the outlet and the inlet, but permits relative rotational displacement between the outlet and the inlet.

18. The well system of claim 17, in which the rotary coupling comprises one or more radially displaceable lugs received in a recess in the inlet.

* * * * *